United States Patent [19]

Pulskamp

[11] Patent Number: 4,671,719

[45] Date of Patent: Jun. 9, 1987

[54] METHOD AND APPARATUS FOR MANUFACTURING PRINTED TABLETS

[76] Inventor: Nicholas R. Pulskamp, 1616 Bushnell Ave., South Pasadena, Calif. 91030

[21] Appl. No.: 852,422

[22] Filed: Apr. 16, 1986

Related U.S. Application Data

[63] Continuation-in-part of Ser. No. 766,494, Aug. 19, 1985, Pat. No. 4,624,452.

[51] Int. Cl.[4] ..... B42C 9/00; B42C 13/04

[52] U.S. Cl. ..... 412/2; 53/157; 53/519; 53/435; 83/200.1; 83/651.1; 83/925 A; 156/250; 156/297; 412/10; 414/42

[58] Field of Search ..... 53/435, 157, 514, 518, 53/519; 83/200.1, 651.1, 925 A; 156/250, 297; 412/2, 8, 10; 414/42, 908; 493/963; 270/95, 58, 60

[56] References Cited

U.S. PATENT DOCUMENTS

| | | | |
|---|---|---|---|
| 2,299,853 | 10/1942 | Slonneger | 83/200.1 |
| 2,320,386 | 6/1943 | Schneider | 83/200.1 |
| 3,026,657 | 3/1962 | Williams et al. | 53/519 X |
| 3,555,978 | 1/1971 | McCool | 270/95 |
| 4,399,602 | 8/1983 | Hancock et al. | 83/200.1 X |
| 4,480,517 | 11/1984 | Miyamoto | 83/210 |

FOREIGN PATENT DOCUMENTS

| | | | |
|---|---|---|---|
| 57-27861 | 2/1982 | Japan | 270/95 |

*Primary Examiner*—Paul A. Bell

*Attorney, Agent, or Firm*—Christie, Parker & Hale

[57] ABSTRACT

A stack of printed sheets is divided into individual tablets by inserting paper boards at intervals of a predetermined number of sheets in the stack. A continuous filament is threaded in zig-zag fashion across each successive board before a binder is coated on one face of the stack to secure the edges of the sheets and boards together. With one end of the filament anchored, the other end is pulled out from between each board and the adjacent sheet in a direction to sever the coating at the edge of the board. As each loop of the zig-zag filament is withdrawn, it cuts the coating at each successive board, dividing the stack into separate tablets.

6 Claims, 4 Drawing Figures

METHOD AND APPARATUS FOR MANUFACTURING PRINTED TABLETS

RELATED APPLICATION

This is a continuation-in-part of application Ser. No. 766,494, filed Aug. 19, 1985, now U.S. Pat. No. 4,624,452.

FIELD OF THE INVENTION

This invention relates to a method and apparatus for cutting printed paper stacks into individual tablets.

BACKGROUND OF THE INVENTION

Notepads in which the individual sheets of the pad have printed material impressed on each sheet have been manufactured by inserting a heavy paper board backing between groups of the printed sheets to form the backing for the notepads. As the printed sheets emerge from the press, they fall into a stack individually sheet-by-sheet. In the above-identified copending application, there is described apparatus for automatically inserting the boards into the stack of printed sheets as the stack is being formed. When the stack of sheets is removed from the press, the stack is already divided at predetermined intervals by the boards. The entire stack is then coated on one side with an adhesive cement. The stack is then divided into individual tablets or notepads by cutting through the cement at each paper board. In the past, this cutting operation has been done manually by inserting the blade of a knife or other cutting instrument between the surface of a board and the adjacent sheet of paper in the stack and then slicing through the adhesive cement to sever the board and associated group of paper sheets from the rest of the stack to form an individual pad or tablet.

SUMMARY OF THE INVENTION

The present invention is directed to a method and apparatus for automatically dividing the stack, after the adhesive cement has been applied, into individual pads. During the stack-forming process, as the sheets drop from the printer, and the boards are inserted, a section of a continuous thread or monofilament line is laid down across each board. This is accomplished by passing thread back and forth from one side to the other side of the stack in zig-zag fashion with each successive insertion of a board, so that when the stack is completed, a continuous thread loops back and forth through the stack from one pad section to the next. After an adhesive coating is applied to one edge of the stacked sheets, the thread is pulled laterally from one end in a direction parallel to the surfaces of the sheets. As each loop is withdrawn, it cuts the adhesive coating as it is pulled from between the adjacent surface of a board and paper sheet. Thus, by pulling one end of the thread, the stack of sheets is separated into a plurality of separate tablets.

BRIEF DESCRIPTION OF THE DRAWINGS

For a more complete understanding of the invention, reference should be made to the accompanying drawings, wherein.

DETAILED DESCRIPTION

Figure 1:
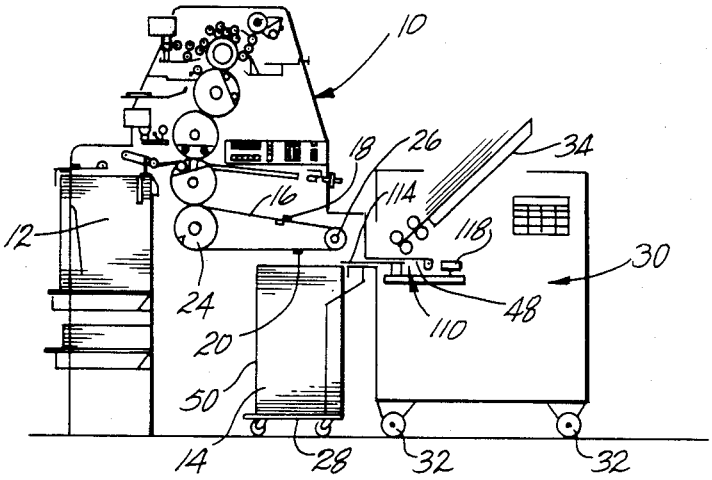
FIG. 1 is a cross sectional view of the invention in combination with a standard printing press.
Figure 4:
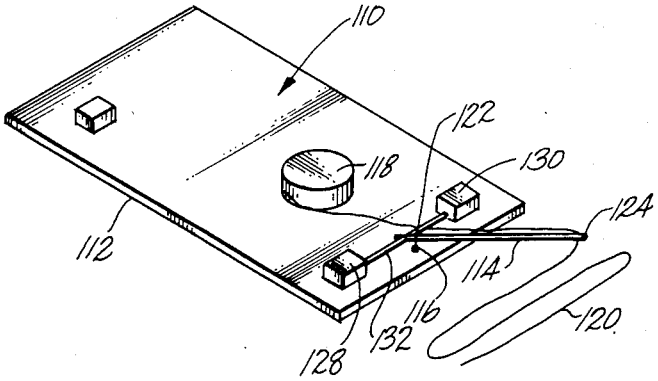
FIG. 4 is a perspective view of the filament distributor.

Referring to FIG. 1 in detail, the numeral 10 indicates generally a standard printer of a type having a chain delivery system. Presses of this type are sold under trade names, such as Multilith, Heidlberg, and A. B. Dick, for example. The press receives one sheet of paper at a time from a stack 12. The sheet is run through the press, printed, and delivered to the top of a stack 14. The press is provided with a chain delivery system which comprises a pair of spaced chains, one of which is indicated at 16 with clamping elements, such as indicated at 18 and 20, bridging the two chains and clamping one edge of a sheet as it comes off the press. The chains are rotated about a pair of sprockets 24 and 26 in a direction to move the sheet of paper across the top of the stack 14, where it is released by opening the clamping elements and allowed to fall by gravity onto the top of the stack.

In the past, it has been the practice to manually insert a paper board on top of the stack following a predetermined number of sheets being delivered to the stack 14. Stack 14 is supported on a dolly 28, enabling the stack to be wheeled away from the press. With the boards inserted at spaced intervals of any desired number of sheets in the stack, one edge of the stack is coated with a rubber cement or the like. The stack can then be divided into individual units of one board with a group of sheets constituting a notepad, for example, by cutting through the layer of cement at the interface between each board and the adjacent stack of sheets. The mechanism for separating the stack by cutting the cement coating is described in detail below.

The board-inserting mechanism, indicated generally at 30, is preferably supported on casters 32, allowing it to be rolled up to the front of the printing press 10. As shown in more detail in FIGS. 2 and 3, the feeder mechanism 30 includes a board-loading table 34 on which the boards are stacked. The loader table is supported in an inclined position by a frame 36. The table includes a pair of adjustable guides 38 and 40 which engage the opposite edges of the stack of boards.

The feeder mechanism, which operates in conventional fashion by removing one board at a time from the stack, includes a retaining roll 41 and a feed roll 42. When the feeder mechanism is actuated, it rotates the feed roll 42, causing a board to be fed past the retaining roll into contact with a pair of rotating thrust rollers 44 and 46. The thrust rollers feed the board against an adjustable deflection table 48 at sufficient velocity to propel the board out of the feeder mechanism into position above the stack 14 formed by the printing press 10. Stop guides 50 at the rear of the stack 14 position the boards in alignment with the stack. The angle of the deflection table 48 is made adjustable by a suitable set of thumb screws 52, which adjust the deflection table 48 about a hinge support 54.

Figure 2:
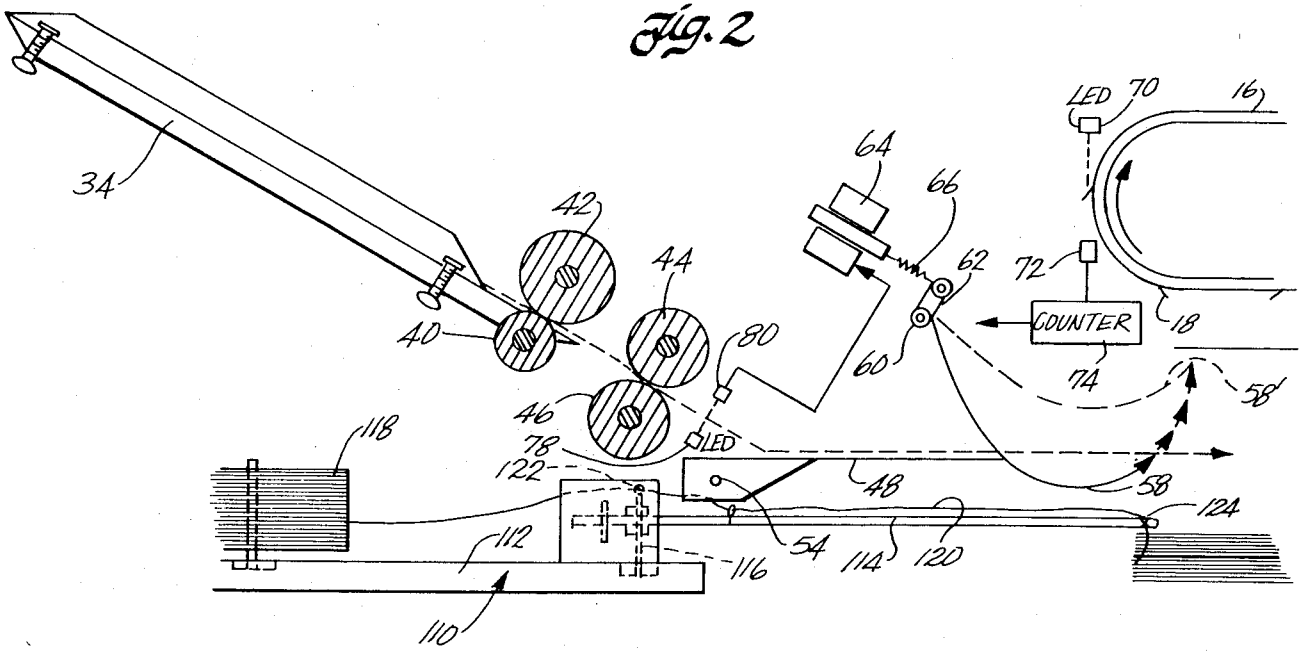
FIG. 2 is a simplified sectional view of the board feeder mechanism and the filament distributor of the present invention.
Figure 3:
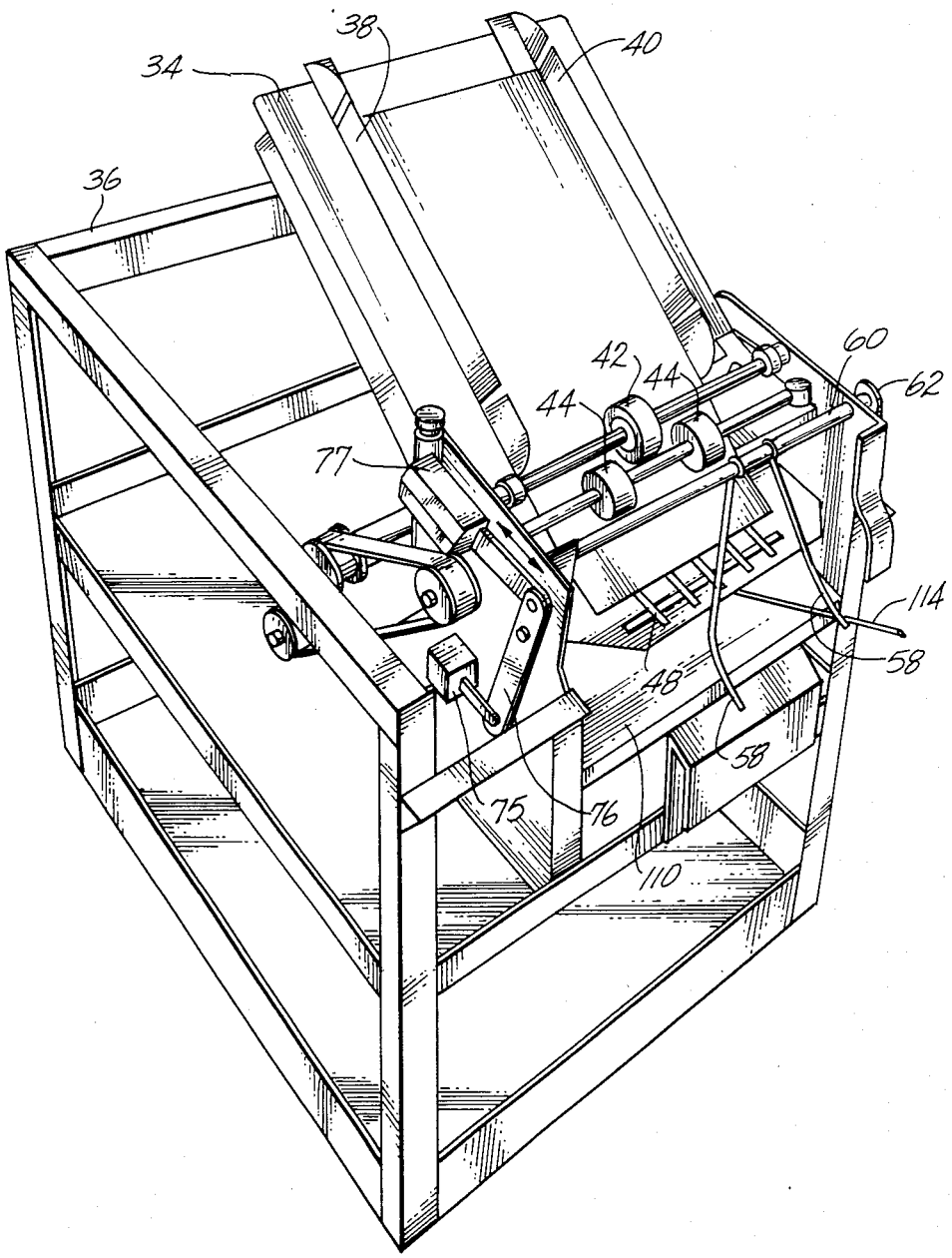
FIG. 3 is a perspective view of the board feed mechanism.

In order to prevent jamming or interference between the board as it is inserted and a falling sheet from the press, it is desirable to ensure an adequate gap between successive sheets being dropped on the stack 14 from the press. This is accomplished, as seen in FIG. 2, by a pair of stiff wire spring fingers 58 which are secured to a rotatably supported rod 60. The other end of the rod 60 is connected to a crank arm 62. The crank arm 62, in turn, is connected to a solenoid 64 through a tension spring 66. When the solenoid 64 is energized, the spring fingers 58 are rotated upwardly to the position indicated at 58'. As the spring fingers are rotated, the outer ends move in an arc which intersects the vertical plane defined by the edges of the falling printed sheets from the press. Thus, the outer ends of the spring fingers 58 rotate into position below the bottom surface of the upper falling sheet, ensuring that a gap is maintained into which the board is inserted as it is thrust into the path of the falling sheets by the action of the thrust rollers 44 and 46.

In operation, as the chain delivery system 16 of the press brings each sheet into position and releases it onto the top of the stack 14, the sheet-clamping unit on the chain drive interrupts a beam of light between a light-emitting diode 70 and a light sensor 72. The output of the sensor 72 actuates a counter 74. Thus, the counter 74 provides a count of the number of sheets released onto the stack by the chain delivery system of the press. The counter can be preset to any count condition, and when it counts a corresponding number of sheets, the counter provides an output pulse which actuates a solenoid 75 mounted on the side of the frame of the feeder assembly. The solenoid, through a suitable linkage arm 76, operates a rack and pinion drive 77 to rotate the feed roller 42. This moves the top board on the board stack into contact with the continuously rotating thrust rollers 44 and 46, causing the board to be ejected into the stack of printed sheets being formed by the printing press 10. As the board is ejected through the thrust rollers, it interrupts a light beam from a light-emitting diode 76, actuating a sensor 78 which, in turn, causes the fingers 58 to rotate into the path of the falling printed sheets.

One of the features of the present invention is an arrangement by which the stack can be later split into individual tablets or pads after one of the side of the stack formed by the edges of the sheets and boards has been coated with a suitable binder, such as a rubber cement. This arrangement includes a filament distributor, indicated generally at 110. The filament distributor includes a base plate 112, which is supported by the frame 36 at a level just below the adjustable deflection table 48. A wand or swinging arm 114 is pivotally supported adjacent one end by a hinge pin 116 secured to the base plate 112. A removable spool 118 on which is wound a monofilament nylon line 120 is also pivotally mounted on the base plate 112. The monofilament line is threaded through a guide hole 122 in the hinge pin 116, then through a guide hole 124 at the outer end of the wand 114. The outer end of the wand 114 projects into the space through which the sheets fall from the chain delivery system of the press onto the top of the stack 14. The wand is caused to swing laterally through this space by a suitable oscillating drive mechanism, such as by a pair of electromagnetic solenoids 128 and 130, which are linked to the wand 114 by a drive member 132. The drive member 132 is pivotally connected to the inner end of the wand 114 so that, as the drive member 132 is oscillated back and forth by alternately energizing one and then the other of the solenoids, the wand is caused to swing back and forth in the space above the stack 12.

In operation, the solenoids 128 and 130 are actuated alternately in response to the output of the counter 74. Thus, every time a board is ejected into the stack by the counter 74, following the release of a predetermined number of printed sheets, the wand 114 is caused to swing from one side to the other of the stack. By anchoring the outer end of the filament to the stack support on one side of the stack, this movement of the wand 22 guides a section of filament laterally across the top of the stack each time a board is released and injected into the stack. Thus, it will be seen that as the wand continues to move back and forth across the stack with each addition of a predetermined number of sheets onto the stack, the filament becomes interwoven with the stack at the intervals corresponding to the positions of the boards. Once the stack is completed, it may be removed from the printing press, and one surface of the stack formed by the edges of the paper sheets in the stack is then coated with a suitable binder, such as a rubber cement, thereby binding the stack together along one edge of the stacked sheets. Once this binding process is completed, a pulling action on one end of the filament in a direction parallel to the plane of the sheets in the stack, and perpendicular to the direction of the filament loops, causes the filament to cut through the layer of binding material as each successive loop of the filament is withdrawn from between layers of the stack. In a single, continuous motion of pulling the filament loops laterally out from between the sheets of the stack in which they have been interwoven, the stack binding is repeatedly severed, dividing the stack into individual pads or tablets.

From the above description, it will be seen that an apparatus and method have been provided by the present invention for easily and accurately dividing the stack of printed sheets into individual groups of sheets, each group of sheets having its own stiffening board attached to the sheets by the edge-binding cement. The monofilament line can be rewound and used again, if desired.

What is claimed is:

1. Method of making paper tablets comprising the steps of:

stacking paper sheets by dropping one sheet at a time;

inserting paper boards successively between selected pairs of the dropped sheets;

passing a section of a continuous filament between each board and the adjacent sheet as each board is inserted, the sections of filament being passed alternately back and forth laterally of the boards with each successive board, whereby the filament zigzags continuously between successive tablets;

applying an adhesive coating to the surface of the stack formed by one edge of the sheets and boards to hold the edges of the stacked sheets together;

anchoring one end of the filament and pulling on the other end of the filament to pull the filament out from between the boards and sheets in a direction to cut through the adhesive coating; and dividing the stack into separate tablets.

2. Apparatus for separating a glued stack of sheets into separate sections comprising:

means for adding sheets successively to a pile of sheets to form a stack of sheets;

means supplying a continuous filament;

shuttle means receiving the filament from the supply means, the shuttle means receiving the filament from the supply means, the shuttle means moving laterally of the stack to pull the filament back and forth across the top of the stack alternately in one direction out in the opposite direction; and means actuating the shuttle means each time a predetermined number of sheets are added to the stack.

3. Apparatus of claim 2 wherein the shuttle means includes an arm pivoted adjacent one end, the arm extending above and swinging laterally across the top of the stack.

4. Apparatus of claim 3 wherein the supply means includes a spool of filament and guide means for guiding the filament from the spool along the length of the arm.

5. Apparatus separating a stack of sheets into individual pads, comprising:

means for forming a stack by dropping a succession of sheets onto a pile; and means passing an additional section of a continuous filament line across the top of the stack each time a predetermined number of sheets are added to the pile, the filament sections of the line extending alternately back and forth in opposite directions and looping around to edges of the intermediate sheets.

6. Apparatus of claim 5 wherein said means passing an additional section of a continuous line across the top of the stack includes an arm pivotally supported adjacent the stack, the arm rotating in a plane parallel to the top of the stack of sheets, means oscillating the arm periodically back and forth across the top of the stack.

* * * * *